US007900548B2

(12) United States Patent
Hoadley et al.

(10) Patent No.: US 7,900,548 B2
(45) Date of Patent: Mar. 8, 2011

(54) PROTECTION SYSTEM INCLUDING A NET

(75) Inventors: David J. Hoadley, Lexington, MA (US); Robert Knochenhauer, Billerica, MA (US); Thieu Truong, North Easton, MA (US); Gary Anderson, Leominster, MA (US); Micheal Farinella, Belmont, MA (US)

(73) Assignee: Foster Miller, Inc., Waltham, MA (US)

( * ) Notice: Subject to any disclaimer, the term of this patent is extended or adjusted under 35 U.S.C. 154(b) by 507 days.

(21) Appl. No.: 11/890,946

(22) Filed: Aug. 8, 2007

(65) Prior Publication Data

US 2010/0294122 A1 Nov. 25, 2010

Related U.S. Application Data

(63) Continuation-in-part of application No. 11/351,130, filed on Feb. 9, 2006.

(51) Int. Cl.

| | |
|---|---|
| ***F41H 11/02*** | (2006.01) |
| ***F41H 13/00*** | (2006.01) |
| ***F42B 12/02*** | (2006.01) |
| ***F42B 12/66*** | (2006.01) |

(52) U.S. Cl. ..... 89/36.17; 89/1.11; 89/902; 89/918; 102/502

(58) Field of Classification Search ..... 89/1.11, 89/1.34, 36.17; 102/502, 504

See application file for complete search history.

(56) References Cited

U.S. PATENT DOCUMENTS

| | | | | |
|---|---|---|---|---|
| 1,198,035 | A | | 9/1916 | Huntington |
| 1,229,421 | A | | 6/1917 | Downs |
| 1,235,076 | A | | 7/1917 | Stanton |
| 2,296,980 | A | | 9/1942 | Carmichael |
| 2,308,683 | A | | 1/1943 | Forbes |
| 2,322,624 | A | | 6/1943 | Forbes |
| 3,633,936 | A | | 1/1972 | Huber |
| 3,656,791 | A | * | 4/1972 | Truesdell ..... 293/107 |
| 3,893,368 | A | | 7/1975 | Wales, Jr. |
| 3,992,628 | A | | 11/1976 | Karney |
| 4,253,132 | A | | 2/1981 | Cover |
| 4,262,595 | A | | 4/1981 | Longerich |
| 4,358,984 | A | | 11/1982 | Winblad |
| 4,768,417 | A | | 9/1988 | Wright |

(Continued)

FOREIGN PATENT DOCUMENTS

| | | |
|---|---|---|
| DE | 691067 | 5/1940 |

(Continued)

OTHER PUBLICATIONS

International Search Report and Written Opinion, dated Jan. 7, 2010, for International Application No. PCT/US2009/002363, 8 pages unnumbered.

*Primary Examiner* — Bret Hayes
(74) *Attorney, Agent, or Firm* — Iandiorio Teska & Coleman

(57) ABSTRACT

A net deployment system which, in one example, includes a manifold assembly including multiple weight ducts and a bladder port. A weight is disposed in each weight duct and each weight is tied to the net. A bladder is behind the net and is over the bladder port. At least one inflator charge is associated with the manifold for inflating the bladder and firing the weights out of the weight ducts to deploy the net in the path of an incoming threat.

19 Claims, 8 Drawing Sheets

U.S. PATENT DOCUMENTS 4,912,869 A 4/1990 Govett
4,928,575 A 5/1990 Smirlock et al.
5,025,707 A 6/1991 Gonzalez
5,069,109 A 12/1991 Lavan, Jr.
5,078,117 A 1/1992 Cover
5,094,170 A 3/1992 Raynaud et al.
5,170,690 A 12/1992 Smirlock et al.
5,191,166 A 3/1993 Smirlock et al.
5,279,199 A 1/1994 August
5,326,101 A * 7/1994 Fay ..... 463/47.4
5,333,532 A 8/1994 Smirlock et al.
5,370,035 A 12/1994 Madden, Jr.
5,373,832 A * 12/1994 D'Andrade ..... 124/69
5,373,833 A * 12/1994 D'Andrade ..... 124/69
5,394,786 A 3/1995 Gettle et al.
5,400,688 A 3/1995 Eninger et al.
5,417,139 A * 5/1995 Boggs et al. ..... 89/1.11
5,435,226 A 7/1995 McQuilkin
5,524,524 A 6/1996 Richards et al.
5,578,784 A 11/1996 Karr et al.
5,583,311 A 12/1996 Rieger
5,622,455 A 4/1997 Anderson et al.
5,646,613 A 7/1997 Cho
5,652,405 A * 7/1997 Rakov ..... 89/7
5,706,795 A * 1/1998 Gerwig ..... 124/71
5,725,265 A 3/1998 Baber
5,739,458 A 4/1998 Girard
5,750,918 A * 5/1998 Mangolds et al. ..... 102/502
5,792,976 A 8/1998 Genovese
5,898,125 A * 4/1999 Mangolds et al. ..... 102/439
5,924,723 A 7/1999 Brantman et al.
6,029,558 A 2/2000 Stevens et al.
6,119,574 A 9/2000 Burkey et al.
6,128,999 A 10/2000 Sepp et al.
6,199,470 B1 * 3/2001 Dewan et al. ..... 89/37.22
6,279,449 B1 8/2001 Ladika et al.
6,282,860 B1 9/2001 Ramirez
6,311,605 B1 11/2001 Kellner et al.
6,325,015 B1 12/2001 Garcia et al.
6,374,565 B1 4/2002 Warren
6,394,016 B2 5/2002 Swartout et al.
6,595,102 B2 7/2003 Stevens et al.
6,626,077 B1 * 9/2003 Gilbert ..... 89/1.11
6,672,220 B2 1/2004 Brooks et al.
6,782,792 B1 8/2004 Edberg et al.
6,805,035 B2 10/2004 Edberg et al.
6,854,374 B1 * 2/2005 Breazeale ..... 86/50
6,901,839 B2 6/2005 Edberg et al.
6,904,838 B1 * 6/2005 Dindl ..... 89/1.1
6,925,771 B2 8/2005 Lee et al.
6,957,602 B1 10/2005 Koenig et al.
7,190,304 B1 3/2007 Carlson
7,305,981 B1 * 12/2007 Lin ..... 124/59
7,308,738 B2 12/2007 Barvosa-Carter et al.
7,328,644 B2 2/2008 Vickroy
7,398,617 B2 * 7/2008 Mattox ..... 43/58
7,412,916 B2 8/2008 Lloyd
7,415,917 B2 * 8/2008 Lloyd ..... 102/473
2001/0032577 A1 10/2001 Swartout et al.
2002/0134365 A1 9/2002 Gray
2003/0217502 A1 11/2003 Hansen
2004/0016846 A1 1/2004 Blackwell-Thompson et al.
2005/0011396 A1 * 1/2005 Burdette et al. ..... 102/498
2005/0016372 A1 1/2005 Kilvert
2005/0278098 A1 12/2005 Breed
2006/0065111 A1 3/2006 Henry
2007/0057495 A1 3/2007 Tesch et al.
2007/0089597 A1 4/2007 Ma
2007/0180983 A1 8/2007 Farinella et al.
2008/0164379 A1 7/2008 Wartmann et al.
2008/0258063 A1 10/2008 Rapanotti
2009/0084284 A1 4/2009 Martinez et al.
2009/0104422 A1 4/2009 Sampson
2009/0173250 A1 7/2009 Marscher et al.
2009/0178597 A1 7/2009 Sliwa, Jr.
2009/0217811 A1 9/2009 Leeming
2009/0266226 A1 10/2009 Beach et al.

FOREIGN PATENT DOCUMENTS

DE 2206404 8/1973
DE 3722420 1/1989
DE 3735426 5/1989
DE 3834367 4/1990
DE 4437412 9/1995
EP 0655603 5/1995
EP 0872705 4/1998
EP 0902250 9/1998
FR 2695467 3/1994
GB 2449055 1/2006
WO WO 99/30966 6/1999
WO WO 2006/134407 12/2006
WO WO 2006/135432 12/2006
WO WO 2008/007001 1/2008
WO WO 2008/079001 7/2008

* cited by examiner

PROTECTION SYSTEM INCLUDING A NET

RELATED APPLICATIONS

This application is a continuation-in-part application of U.S. patent application Ser. No. 11/351,130, filed Feb. 9, 2006, entitled "Vehicle Protection System".

GOVERNMENT RIGHTS

This invention was made with U.S. Government support under DARPA contract No. HR0011-05-C-0056. The Government may have certain rights in the subject invention.

FIELD OF THE INVENTION

This subject invention relates to counter measure systems and, in particular, to an easy to install, fairly inexpensive, and more effective vehicle protection system.

BACKGROUND OF THE INVENTION

Rocket Propelled Grenades (RPGs) and other threats used by enemy forces and insurgents are a serious threat to troops on the battlefield, on city streets, and in open country. RPG weapons are relatively inexpensive and widely available throughout the world. There are variety of RPG warhead types, but the most prolific are the RPG-7 and RPG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPG's pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The RPG-7 and RPG-7M are the most prolific class of RPG weapons, accounting for a reported 90% of the engagements. RPG-18s have been reported as well accounting for a significant remainder of the threat encounters. Close engagements 30 meters away occurs in less than 0.25 seconds and an impact speed ranging from 120-180 m/s. Engagements at 100 meters will reach a target in approximately 0.5 second and at impact speeds approaching 300 m/s.

The RPG-7 is in general use in Africa, Asia, and the Middle East and weapon caches are found in random locations making them available to the inexperienced insurgents. Today, the RPG threat in Iraq is present at every turn and caches have been found under bridges, in pickup trucks, buried by the road sides, and even in churches.

Armor plating on a vehicle does not always protect the vehicle's occupants in the case of an RPG impact and no known countermeasure has proven effective.

Certain prior art discloses the idea of deploying an airbag (U.S. Pat. No. 6,029,558) or a barrier (U.S. Pat. No. 6,279,449) in the trajectory path of a munition to deflect it but such countermeasure systems would be wholly ineffective in the face of a RPG.

Other prior art discloses systems designed to intercept and destroy an incoming threat. See, e.g., U.S. Pat. No. 5,578,784 which discloses a projectile "catcher" launched into the path of a projectile. Many such interception systems are ineffective and/or expensive, complex, and unreliable.

SUMMARY OF THE INVENTION

It is therefore an object of this invention to provide a more effective and reliable protection system for vehicles and structures.

It is a further object of this invention to provide such a system which is fairly simple in design, easy to install and remove, and which is inexpensive.

The subject invention results from the realization that a more effective and reliable protection system is effected by a shield such as a net typically deployable outward from a vehicle or structure when an incoming RPG or other threat is detected and preferably designed to disarm the threat.

The subject invention, however, in other embodiments, need not achieve all these objectives and the claims hereof should not be limited to structures or methods capable of achieving these objectives.

The subject invention features a net deployment system which, in one embodiment, includes a net, a manifold assembly including multiple weight ducts and a bladder port. A weight is in each weight duct and each weight is tied to the net. A bladder is behind the net and is over the bladder port. At least one inflator charge is associated with the manifold for inflating the bladder and firing the weights out of the weight ducts to deploy the net in the path of an incoming threat.

In one example, the manifold assembly has a central fitting including the bladder port and the weight ducts extend outwardly therefrom. The manifold assembly may further include opposing inflator charge plenums extending outwardly from the central fitting and there is at least one inflator charge in each plenum. In one example, there is an inflator charge plenum between each pair of weight ducts.

The weights may be made of foam. The typical net has four corners and there is a weight tied to each corner of the net. The preferred bladder includes a broad flat top and a side wall terminating in a flange securable over the bladder port. The net is then folded on the broad flat top of the bladder. One preferred net is square and between 2-3 m on a side and is between 30 and 60 mm mesh.

One net deployment system in accordance with this invention includes a net and a manifold assembly including a central fitting including a bladder port, weight ducts extending outwardly from the central fitting, and at least one inflator charge plenum. A weight is in each weight duct and each weight is tied to the net. A bladder is behind the net and is over the bladder port. At least one inflator charge is in the plenum for inflating the bladder and firing the weights out of the weight ducts to deploy the net in the path of an incoming threat.

In another embodiment, the subject invention features a net deployment system comprising a lengthy housing with a channel therein, a net folded in the channel, and a lengthy bladder fixed to the housing and in the channel behind the net. There are attachments between the net and the bladder, and at least one inflator charge for inflating the bladder to deploy the net out of the channel.

The preferred attachments are breakaway attachments such as string or tie wraps. In one example, the housing includes a clamping strip therealong and the bladder is clamped to the clamping strip via a clamp. The bladder may include pockets with reinforcing strips therein disposed on opposite sides of the clamping strip. The preferred bladder includes a flap therealong including grommets therein for the attachments. The bladder may also include closure arms releasably securable together over the net.

The typical net is square and between 2-3 m on a side and is between 30 and 60 mm mesh. The typical housing and the typical bladder are between 200-280 cm long.

The subject invention also features a protection system comprising a sensor subsystem for detecting an incoming threat, a flexible package net in a housing, and a net deployment subsystem including a bladder packaged in the housing behind the net, at least one inflator charge for inflating the bladder. A fire control subsystem is responsive to the sensor subsystem and is configured to activate the inflator charge to inflate the bladder and deploy the net in the path of incoming threat.

One net deployment subsystem includes a manifold assembly in the housing including multiple weight ducts and a bladder port, a weight in each weight duct, each weight tied to the net, and the bladder is over the bladder port. In another embodiment, the housing is lengthy and has a channel therein, the bladder is lengthy and is fixed to the housing and in the channel, and there are attachments between the net and the bladder.

A net deployment system in accordance with the subject invention features a net, a housing for the net, a bladder in the housing behind the net, and at least one inflator charge associated with the housing for inflating the bladder to deploy the net.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
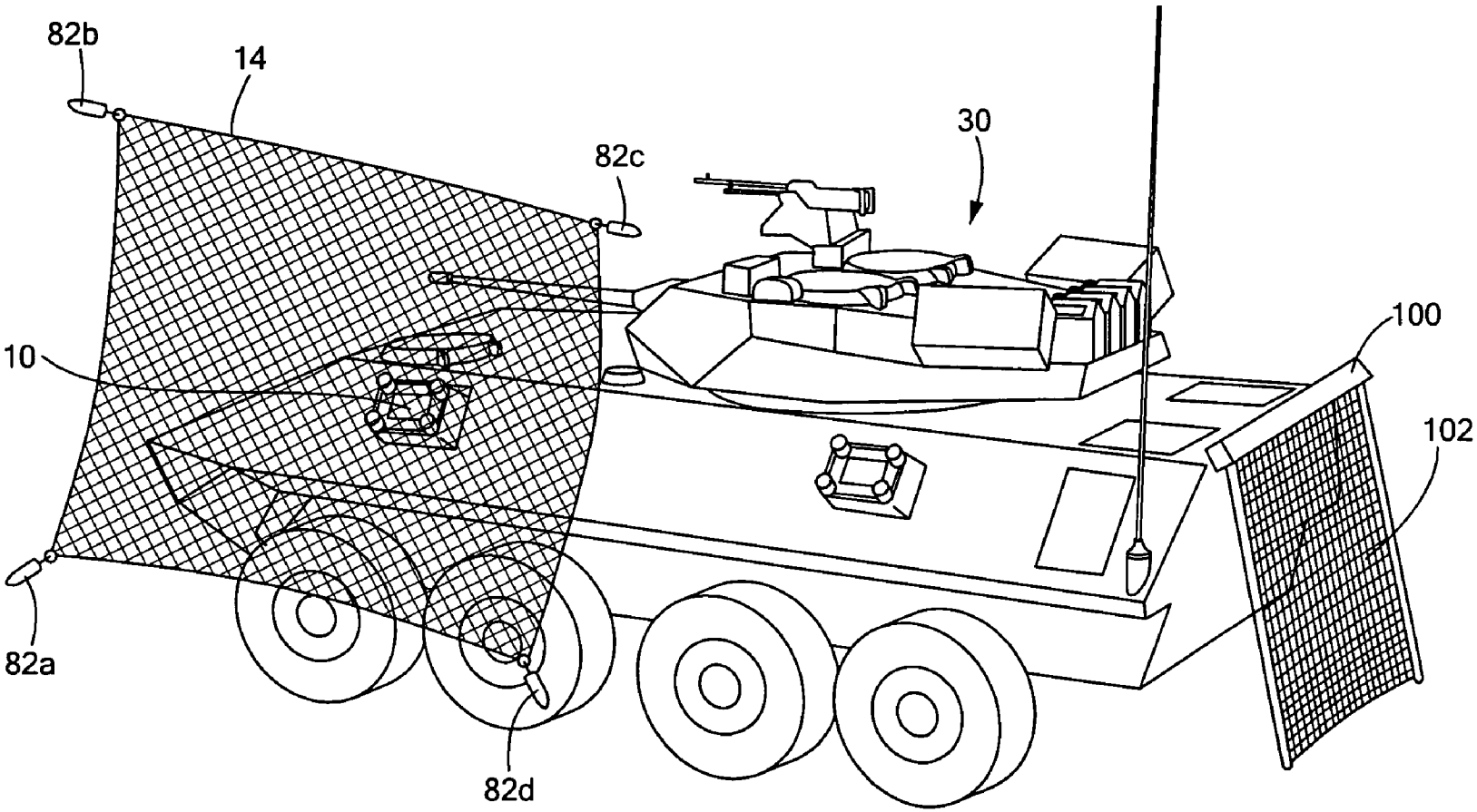
FIG. 1 is a highly schematic three-dimensional view showing two different embodiments of a vehicle protection system in accordance with the subject invention mounted on a vehicle.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

In one specific embodiment, a vehicle or structure protection system in accordance with the subject invention includes deployment box 10, FIG. 1 releasably attached to the exterior of vehicle or other structure in any desired location. In this way, the protection system of this invention can be used as desired on any vehicle configuration and in any location on the vehicle.

Deployment box 10 which includes a net deployment subsystem can be mounted to a door or other panel of military vehicle 30 via straps and/or hook and loop fasteners and net 14 deployed to its full extent (e.g., 72" long by 72" wide) 36" from vehicle 30 in the trajectory path of a threat, e.g., an RPG.

In any embodiment, the deployment subsystem can be attached to all the door panels of vehicle 30, its roof, its hood, its front and rear bumpers, and the like to provide complete vehicle coverage. Net deployment subsystem 100 is shown attached to the rear of vehicle 30.

Figure 2:
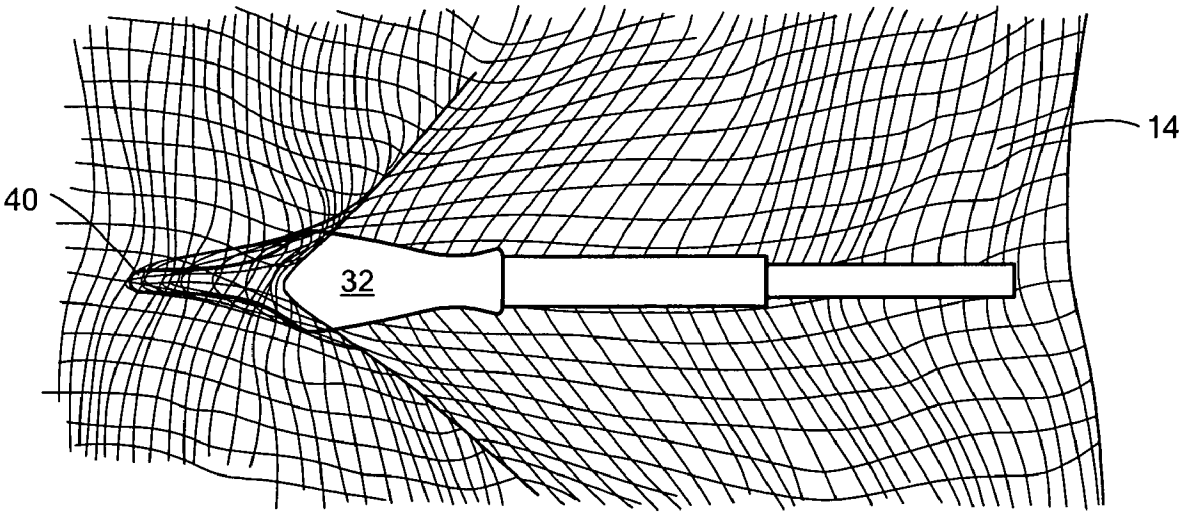
FIG. 2 is a schematic view front showing how the net of the vehicle protection subsystems of FIG. 1 duds an RPG-7 in order to defend a vehicle or other structure and its occupants.

Net 14, FIG. 2 functions to disarm threat 32 rather than to deflect or destroy it. Threat 32 has a nose 40 of a certain diameter and the mesh size of net 14 (typically 30-60 mm) is preferably tailored to capture threat 32 and in so doing destroy the impact fusing running just under the skin of threat 32 so that when nose 40 strikes a target, the threat has now been disarmed and the impact will not trigger detonation of the RPG explosive. The ultralight net barrier, while not triggering the fuse, collapses the RPG ogive, this then shorts its fuse, and duds the round.

The preferred net has a knotless weave for increased strength (e.g., an "ultracross" weave) and is made of "Dyneema" or PBO (poly P-phenylene-2,6 bezibisoxazole) material with a line diameter of between 0.5 mm to 3 mm. The net material, construction, and line diameter may vary depending upon the specific implementation, its location on a vehicle or structure, the vehicle or structure type, and the different types of threats likely to be encountered. "Net" as used herein, means not only traditional nets but also scrims, fabrics with loose weaves, and other structures designed to disarm incoming threats.

Figure 3:
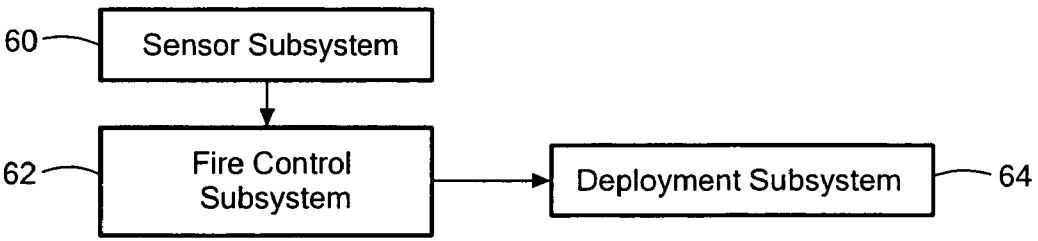
FIG. 3 is a block diagram showing the primary components associated with a defense system in accordance with the subject invention.

A complete system in accordance with one example of the subject invention also includes a sensor subsystem 60, FIG. 3. The sensor subsystem may include a radar system with an antenna. Deployment subsystem 64 is activated by fire control subsystem 62 which receives a signal from sensor subsystem 60 indicating the presence of an incoming threat. Box 10, FIG. 1 may include all or portions of sensor subsystem 60 and/or fire control subsystem 62. The deployed disarming shield subsystem may also include additional nets. The mesh of these multiple nets may be aligned or overlapping as desired when packaged in the deployment box and when deployed. Preferably, the layers or plies of net material do not have their openings aligned.

Those skilled in the art will appreciate that sensor subsystem 60, FIG. 3 is not limited to radar based techniques. U.S. Pat. Nos. 6,279,449 and 6,029,558, incorporated herein by this reference, disclose Doppler radar systems but acoustic or optical based sensors (see U.S. Pat. No. 5,578,784 also incorporated herein by this reference) and other sensor subsystems are possible in connection with the subject invention. Various fire control circuitry and threat size and characterization systems are also known. Also, means other than an inflated bladder and ballistic weights may used to deploy the net are also possible in connection with the subject invention as discussed below. Moreover, the system of this invention is intended to work in combination with structures other than vehicles including check point stations, bunkers, and other shelters.

The net material may include lines of PBO material 0.9 mm diameter (braided, 4 ply, 35 mm mesh) or a larger diameter line net including 3 mm diameter lines of PBO material (braided, 28 ply, 45-55 mm mesh).

It may be advantageous to include more than one net in the deployment subsystem. It was found in testing that folds of a smaller line diameter net, in some cases, was sometimes pierced by a munition without duding. Adding additional layers or plies would sometimes result in the munition detonating on the net. A single layer larger diameter line net could also result in the munition detonating upon striking the net. But, surprisingly, when three layers of the smaller line diameter net were added in front of a single layer of the larger diameter line net, the munition did not pierce the net, did not detonate upon striking the net, and was successfully duded. It is believed this net system works well because the smaller diameter line net layers affects the response of the piezo charge generator of the munition and, when the munition then strikes the larger diameter line net, it disarms the net as explained above and/or the piezo charge generator, affected by the smaller line diameter net layers, is unable to generate a sufficient charge to detonate the munition. Also, it appears the smaller line diameter net directs a hole in the larger diameter line net to the munition nose and carries with it the smaller line diameter net plies to move successfully dud the munition.

Figure 4:
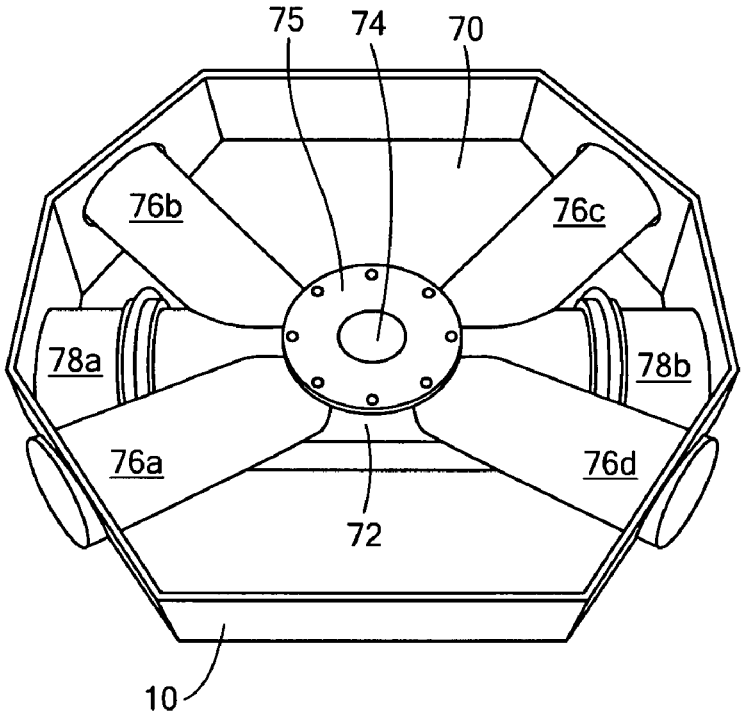
FIG. 4 is schematic three-dimensional top view showing an example of a net deployment system in accordance with the subject invention.

In one embodiment, the net deployment subsystem includes manifold assembly 70 in box housing 10, FIG. 4. Central fitting 72 includes bladder port 74. Extending outwardly from central fitting 72 are weight ducts 76*a*-76*d* and opposing plenums 78*a* and 78*b*, one between each pair of weight ducts as shown. Inflator charges 80*a* and 80*b*, FIG. 6 (typically used to inflate automobile airbags) are loaded, one in each plenum 78*a* and 78*b*, FIG. 4 via an end cap or cover therefore, not shown. Weights 82*a*-82*d*, FIG. 5 typically made of foam rubber, are loaded, one in each weight duct as shown. Preferably, as shown for weight 82*c*, each weight has a covering with an end flap 84*c* with grommets therein for tying each weight to a corner of net 14, FIG. 7. Bladder 90, FIG. 5, is behind net 14 in FIG. 7 and over bladder port 74, FIG. 4 as shown in FIG. 5.

Figure 6:
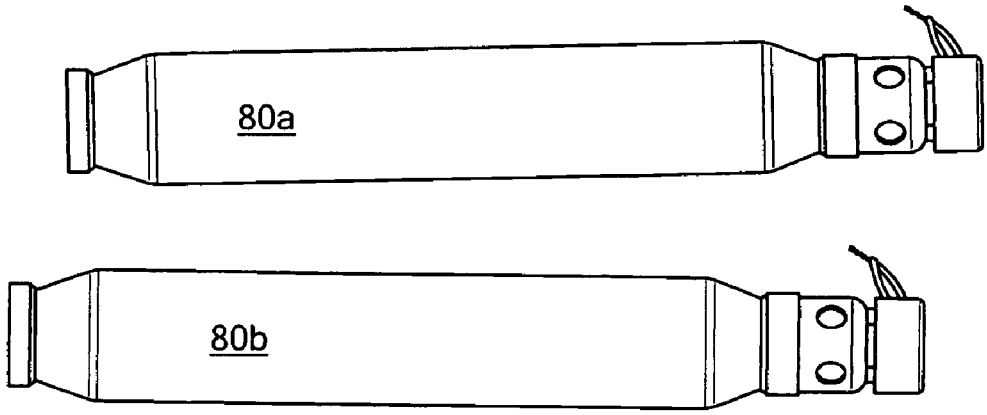
FIG. 6 is a schematic three-dimensional side view showing an example of inflator charges used in the net deployment system shown in FIG. 4.
Figure 7:
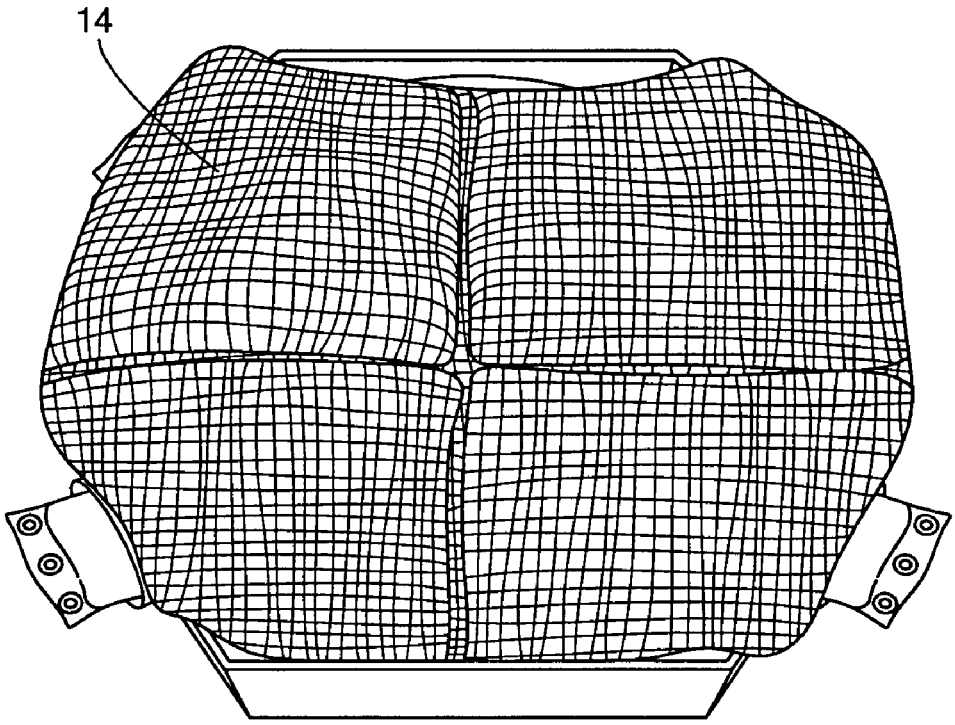
FIG. 7 is a schematic three-dimensional top view showing the net deployment system of FIGS. 4 and 5 with the net now installed.

In this way, when the inflator charges (80*a*, 80*b*, FIG. 6) in the plenums (78*a*, 78*b*, FIG. 4) are activated, the bladder (90, FIG. 5) inflates and the weights (82*a*-82*d*, FIG. 5) are fired out of the weight ducts (76*a*-76*d*, FIG. 4) to deploy net 14, FIG. 7 in the path of an incoming threat as shown in FIG. 1.

Figure 5:
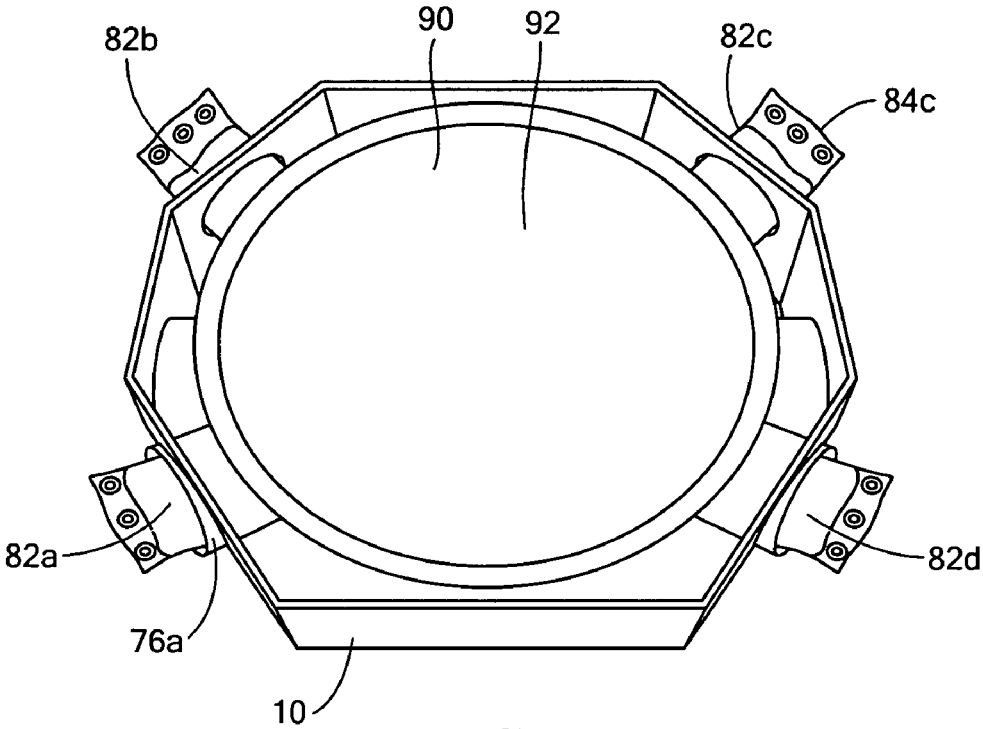
FIG. 5 is a schematic three-dimensional top view showing the structure of the bladder and also the net weights of the deployment subsystem shown in FIG. 4.
Figure 8:
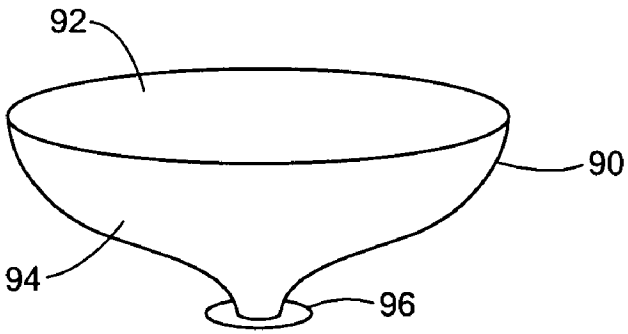
FIG. 8 is a highly schematic front view of a typical bladder for the net deployment system shown in FIGS. 4, 5, and 7.

As shown in FIGS. 5 and 8, bladder 90 preferably has a broad flat top 92 and side wall 94 terminating in flange 96 securable (via a ring, for example) to flange 75, FIG. 4 surrounding bladder port 74. Fasteners such as bolts can be used to secure the ring over bladder flange 96 securing it to flange 75. Net 14, FIG. 7 is then folded over broad flat top portion 92, FIG. 5 of bladder 90. The preferred net 14, FIGS. 1 and 14 is square 2-3 meters on a side with 30-60 mm mesh. In one example, the net was 2.4 meters square and housing assembly 10, FIG. 4 was 50 cm×40 cm×18 cm deep. Inflators 80*a* and 80*b*, FIG. 6 were standard automotive side airbag inflators. Each foam rubber net spreader corner weight 82*a*-82*d*, FIG. 5 weighed 320 g.

The typical sensor subsystem 60, FIG. 3 is able to identify the threat based on its signature and velocity and determine the azimuth angle of the threat and also its range and speed to predict if and when a strike will occur. Fire control subsystem 82 is responsive to sensor subsystem 60 to electrically activate inflators 80*a* and 80*b*, FIG. 6 to deploy the net at a fixed time prior to the predicted strike to thereby sufficiently deploy the net to an optimum standoff distance to achieve RPG defeat. In testing, the net was a single layer net manufactured from ultra high strength fiber PBO with 28 ply, 55 mm mesh (27.5 mm square netting elements). The net was 2.4 meters square and weighed 2.7 kg.

Figure 9:
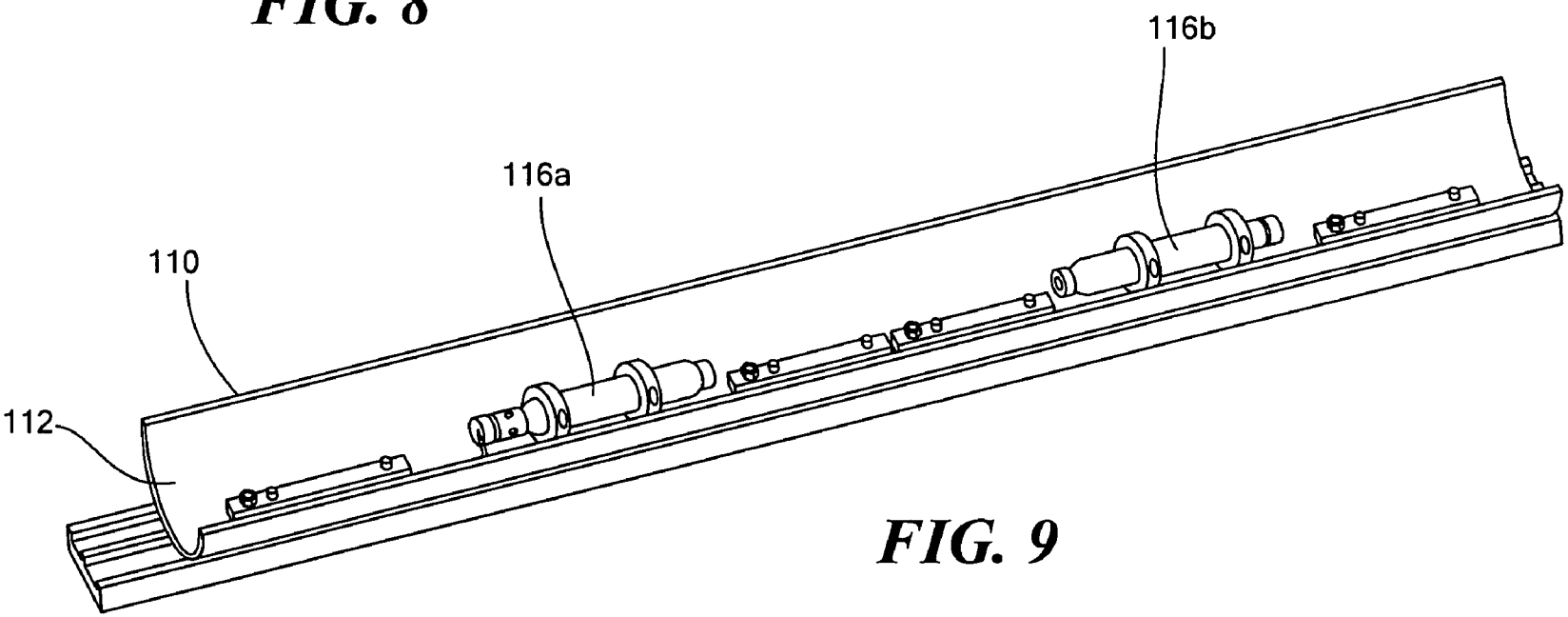
FIG. 9 is a schematic three-dimensional top view of another embodiment of a net deployment system in accordance with the subject invention.
Figure 10:
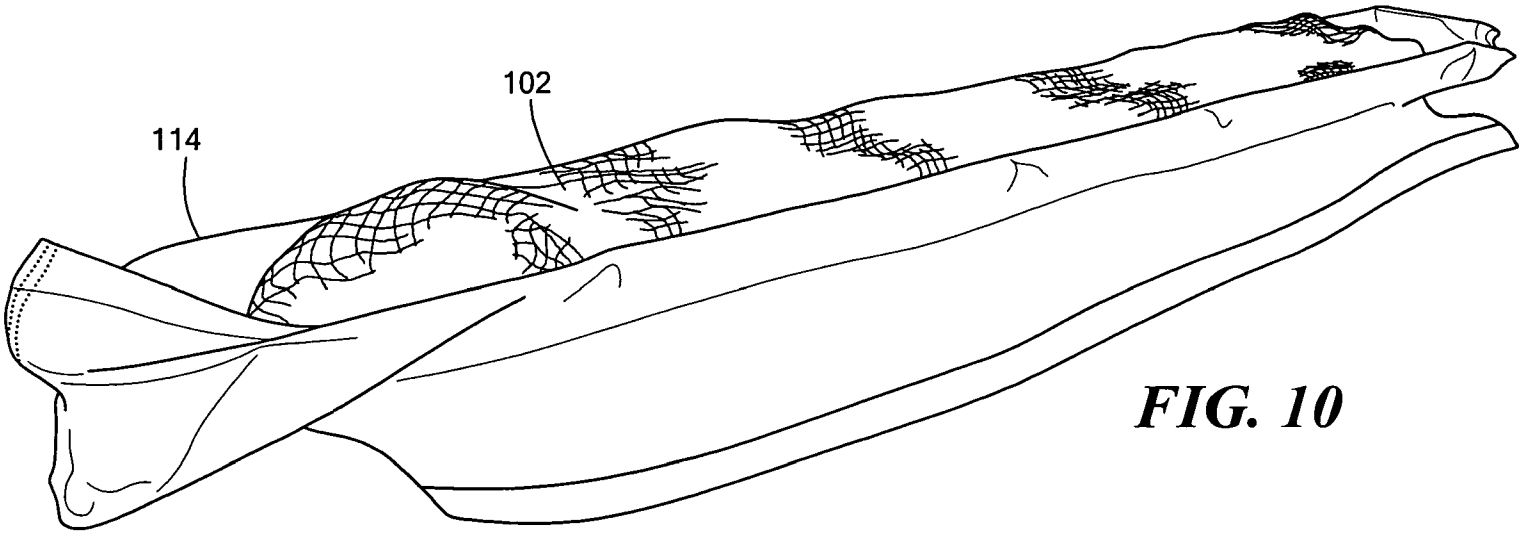
FIG. 10 is a schematic three-dimensional top view showing the net deployment system of FIG. 9 with the bladder and the net now in place.
Figure 11:
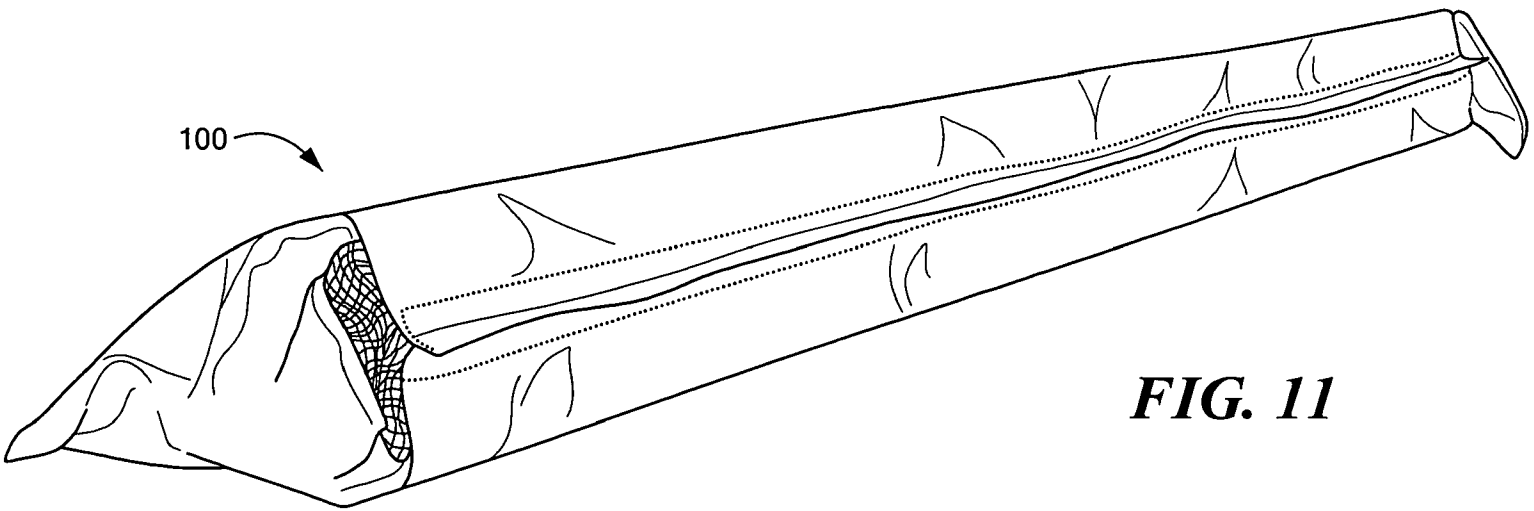
FIG. 11 is a schematic three-dimensional view showing the complete net deployment system ready for attachment to a vehicle or other structure.

In another embodiment, net deployment system 100, FIG. 1 deploys net 102 in a curtain configuration downwardly and outwardly from vehicle 30. Net deployment device 100, in one preferred example, includes lengthy (e.g., 200-280 cm long) housing 110, FIG. 9 with channel 112 therein. Lengthy bladder 114, FIG. 10 is fixed to the housing and behind folded net 102 also in channel 112. Unlike the design discussed above, an edge of net 102 is attached to bladder 114. Inflator charges 116*a* and 116*b*, FIG. 9 (two to four) are preferably placed in channel 112 between housing 110 and the bladder to inflate the bladder and with respect to the housing and to deploy the net out of the channel as shown in FIG. 1. FIG. 11 shows the complete assembly ready for mounting on a vehicle.

Figure 12A:
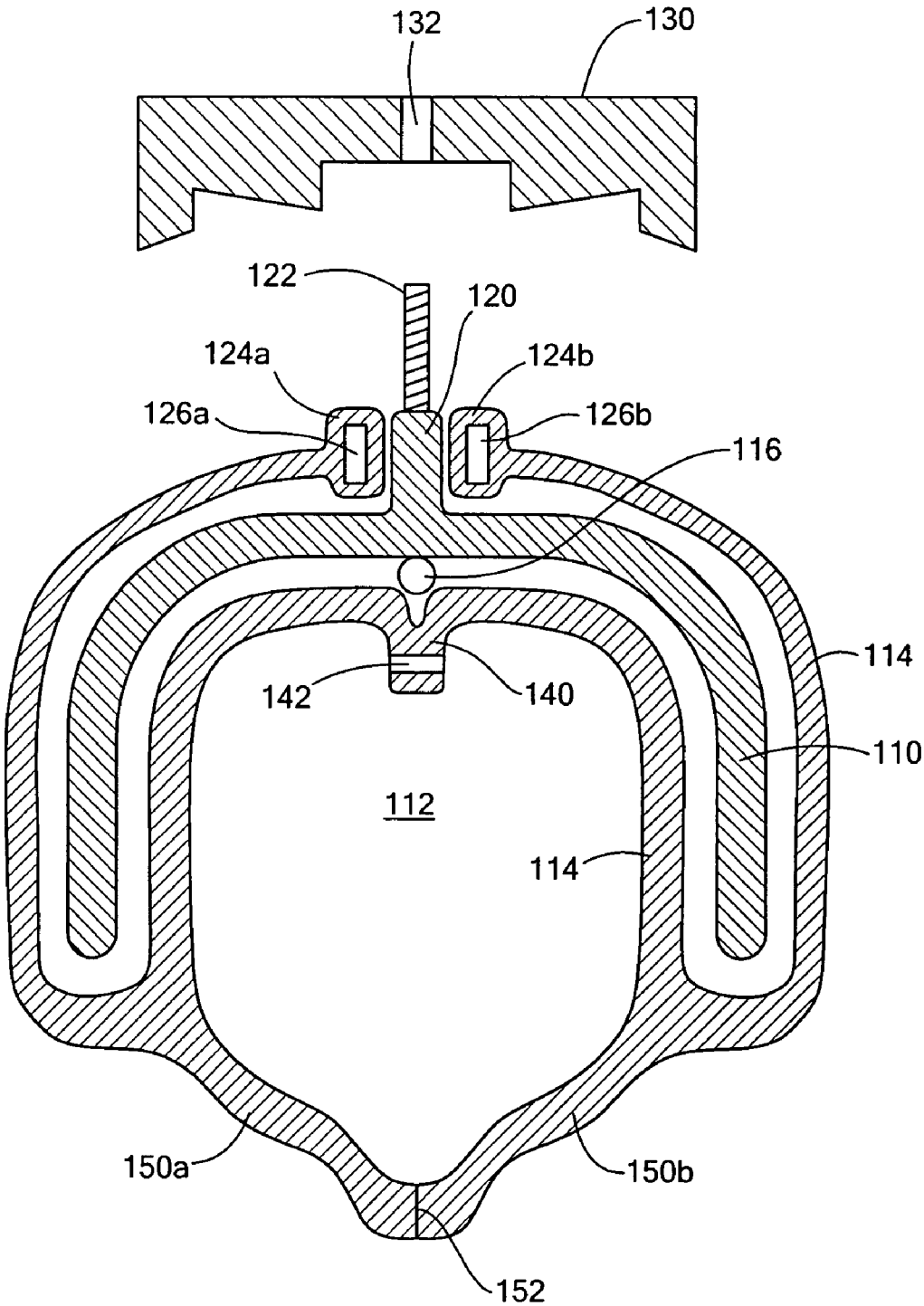
FIG. 12A is a schematic cross-sectional partially exploded view of the net deployment system shown in FIG. 11 before the bladder is expanded.
Figure 12B:
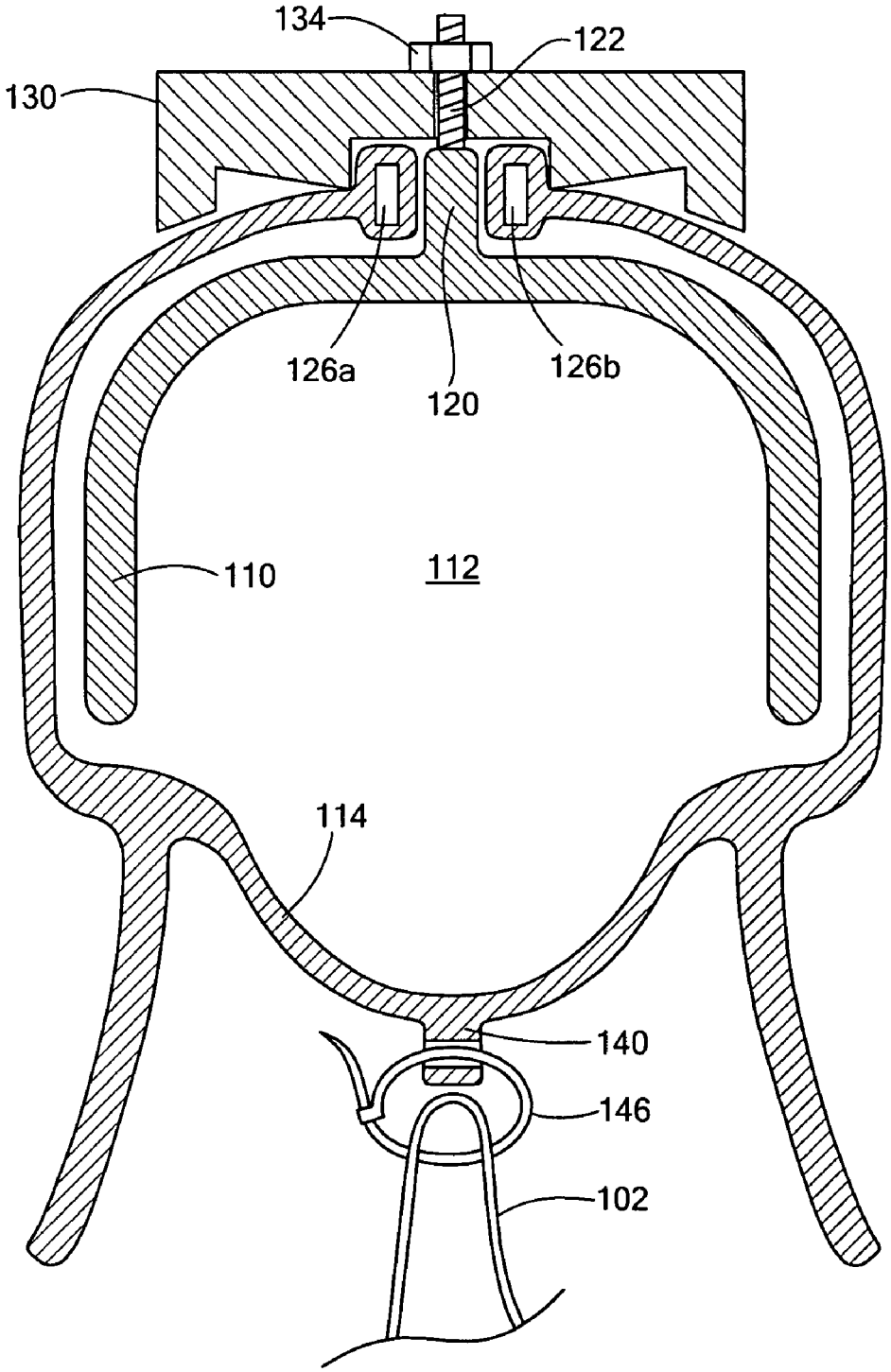
FIG. 12B is schematic cross-sectional view similar to FIG. 12A showing the bladder now in its expanded state.

FIGS. 12A-12B show housing 110 and bladder 114 in one example. Net 102, FIG. 10 is folded in channel 112 over bladder 114 but net 102 is not shown in FIG. 12A for clarity.

Housing 110 includes back side clamping strip 120 thereal-long with spaced bolts such as bolt 122. The part of bladder 114 outside of channel 112 includes pockets 124*a* and 124*b* each with a reinforcing strip 126*a* and 126*b* therein. These reinforcing strips are clamped to clamping strip 120 via clamp 130 with spaced bolt holes such as bolt hole 132 for receiving bolt 122. Nut 134, FIG. 12B secures clamp 130 to clamping strip 120. In this way, bladder 114 is fixed to the housing to create a sealed chamber.

The portion of bladder 114, FIG. 12A inside channel 112 includes flap 140 with spaced grommets such as grommet 142 therein. Attachments such string or tie wraps 146, FIG. 12B loop through these grommets in flap 140 and through the net and thereby releasably attach net 102 to bladder 112 in a way such that after deployment (see FIG. 1), the net breaks away from the bladder to prevent entanglement with vehicle 30, FIG. 1 and the like.

As shown in FIGS. 12A-12B, bladder 114 also includes closure arms 150*a* and 150*b* releasably securable over the net via hook and loop fasteners at seam 152.

In this way, when inflator charge 116, FIG. 12A is activated by the fire control subsystem 62, FIG. 3 as discussed above, bladder 114 inflates with respect to housing 114 (see FIG. 12B) and deploys the net out of channel 112 in a curtain configuration as shown in FIG. 1 for net 102.

The discussion above concerning the embodiment of FIGS. 4-8 applies to the embodiment shown in FIGS. 9-12 regarding the net and the side airbag inflators. In one example, housing 110, FIGS. 12A and 12B was 240 cm long 15 cm wide and 10 cm. Bladder 114 was also 240 cm long. Net 102 was generally the same configuration as net 14, FIG. 7.

In any embodiment, the result is a more effective and reliable protection system which is reliable, fairly simple in design and easy to install and which can also be manufactured fairly inexpensively. Protection is effected by a shield typically quickly deployable outward from a vehicle or other structure when an incoming RPG or other threat is detected. The shield is designed primarily to disarm the threat instead of deflect or intercept and destroy it.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A net deployment system comprising:

a net;

a manifold assembly including multiple weight ducts and a bladder port;

a weight in each weight duct, each weight tied to the net;

a bladder behind the net and over the bladder port; and at least one inflator charge associated with the manifold assembly for inflating the bladder and firing the weights out of the weight ducts to deploy the net in the path of an incoming threat.

2. The net deployment system of claim 1 in which the manifold assembly has a central fitting including the bladder port and the weight ducts extend outwardly therefrom.

3. The net deployment system of claim 2 in which the manifold assembly further includes opposing inflator charge plenums extending outwardly from the central fitting and there is at least one inflator charge in each plenum.

4. The net deployment system of claim 3 in which there is an inflator charge plenum between each pair of weight ducts.

5. The net deployment system of claim 1 in which the weights are made of foam.

6. The net deployment system of claim 1 in which the net has four corners and there is a weight tied to each corner of the net.

7. The net deployment system of claim 1 in which the bladder includes a broad flat top and a side wall terminating in a flange securable over the bladder port.

8. The net deployment system of claim 7 in which the net is folded on the broad flat top of the bladder.

9. The net deployment system of claim 1 in which the net is square and between 2-3 m on a side.

10. The net deployment system of claim 1 in which the net is between 30 and 60 mm mesh.

11. A net deployment system comprising:

a net;

a manifold assembly including:

a central fitting including a bladder port, weight ducts extending outwardly from the central fitting, and at least one inflator charge plenum;

a weight in each weight duct, each weight tied to the net;

a bladder behind the net and over the bladder port; and at least one inflator charge in the plenum for inflating the bladder and firing the weights out of the weight ducts to deploy the net in the path of an incoming threat.

12. The net deployment system of claim 11 in which the manifold assembly includes opposing inflator charge plenums extending outwardly from the central fitting and there is at least one inflator charge in each plenum.

13. The net deployment system of claim 12 in which the at least one inflator charge plenum is an inflator charge plenum between each pair of weight ducts.

14. The net deployment system of claim 11 in which the weights are made of foam.

15. The net deployment system of claim 11 in which the net has four corners and there is a weight tied to each corner of the net.

16. The net deployment system of claim 11 in which the bladder includes a broad flat top and a side wall terminating in a flange securable over the bladder port.

17. The net deployment system of claim 16 in which the net is folded on the broad flat top of the bladder.

18. The net deployment system of claim 11 in which the net is square and between 2-3 m on a side.

19. The net deployment system of claim 11 in which the net is between 30 and 60 mm mesh.

* * * * *